US011840799B2

(12) United States Patent
Yoshioka et al.

(10) Patent No.: US 11,840,799 B2
(45) Date of Patent: Dec. 12, 2023

(54) MESH MEMBER, SIEVE, AND SCREEN PRINTING PLATE

(71) Applicant: NBC MESHTEC INC., Tokyo (JP)

(72) Inventors: Yuki Yoshioka, Tokyo (JP); Nobukazu Motojima, Tokyo (JP); Tsuruo Nakayama, Tokyo (JP)

(73) Assignee: NBC MESHTEC INC., Tokyo (JP)

( * ) Notice: Subject to any disclaimer, the term of this patent is extended or adjusted under 35 U.S.C. 154(b) by 278 days.

(21) Appl. No.: 16/969,635

(22) PCT Filed: Mar. 12, 2019

(86) PCT No.: PCT/JP2019/009973

§ 371 (c)(1),
(2) Date: Aug. 13, 2020

(87) PCT Pub. No.: WO2019/176933

PCT Pub. Date: Sep. 19, 2019

(65) Prior Publication Data

US 2020/0399821 A1 Dec. 24, 2020

(30) Foreign Application Priority Data

Mar. 14, 2018 (JP) ..... 2018-047095
Mar. 14, 2018 (JP) ..... 2018-047096

(51) Int. Cl.
*B07B 1/46* (2006.01)
*D06M 11/74* (2006.01)
*B41N 1/24* (2006.01)

(52) U.S. Cl.
CPC ..... *D06M 11/74* (2013.01); *B07B 1/4672* (2013.01); *B41N 1/247* (2013.01)

(58) Field of Classification Search
CPC ..... D06M 11/74; B07B 1/4672; B41N 1/247
See application file for complete search history.

(56) References Cited

U.S. PATENT DOCUMENTS 1,934,643 A * 11/1933 Rafton ..... B07B 1/4618 139/425 A
5,473,981 A * 12/1995 Mazaki ..... B41N 1/247 139/383 R
9,035,188 B2 5/2015 Akiba et al.
(Continued)

FOREIGN PATENT DOCUMENTS

CN 106884315 6/2017
EP 3 859 057 8/2021
(Continued)

OTHER PUBLICATIONS

International Search Report dated Jun. 4, 2019 in corresponding International (PCT) Application No. PCT/JP2019/009973.
(Continued)

*Primary Examiner* — Christopher E Mahoney
*Assistant Examiner* — Marissa Ferguson-Samreth
(74) *Attorney, Agent, or Firm* — Wenderoth, Lind & Ponack, L.L.P.

(57) ABSTRACT

To provide a mesh member such that a static charge can be suppressed. Provided is a mesh member including a mesh woven fabric and a coating layer that is formed on the surface of the mesh woven fabric and contains a carbon nanotube and/or graphene.

8 Claims, 5 Drawing Sheets

(56) References Cited

U.S. PATENT DOCUMENTS

| | | | | |
|---|---|---|---|---|
| 2009/0294334 | A1* | 12/2009 | Knepp | B07B 1/4672 140/10 |
| 2012/0315065 | A1 | 12/2012 | Akiba et al. | |
| 2014/0130687 | A1 | 5/2014 | Shibusawa et al. | |
| 2020/0001642 | A1* | 1/2020 | Kurahashi | H05K 3/1225 |

FOREIGN PATENT DOCUMENTS

| | | | |
|---|---|---|---|
| JP | 46-15597 | | 5/1971 |
| JP | 63-15795 | * | 1/1988 |
| JP | 05125638 | * | 5/1993 |
| JP | 2010-42612 | | 2/2010 |
| JP | 2010-188294 | | 9/2010 |
| JP | 2010-261108 | | 11/2010 |
| JP | 2013-248828 | | 12/2013 |
| JP | 2014-108617 | | 6/2014 |
| JP | 5802752 | | 9/2015 |
| JP | 2016-125174 | | 7/2016 |
| JP | 2018-167498 | | 11/2018 |
| JP | 2019-60067 | | 4/2019 |
| KR | 10-2011-0118757 | | 11/2011 |
| KR | 1020110118757 | * | 11/2011 |
| TW | 202024410 | | 7/2020 |
| WO | 2009/028379 | | 3/2009 |
| WO | 2011/108669 | | 9/2011 |

OTHER PUBLICATIONS

Translation of International Preliminary Report on Patentability and Written Opinion of the International Searching Authority dated Sep. 24, 2020 in International (PCT) Application No. PCT/JP2019/009973.

* cited by examiner

MESH MEMBER, SIEVE, AND SCREEN PRINTING PLATE

TECHNICAL FIELD

The present invention relates to a mesh member in which a static charge can be suppressed.

BACKGROUND ART

Examples of a mesh member using a mesh woven fabric include sieving nets of sieves used for sieving and screen fabrics of screen printing plates used for screen printing. Recently, various technologies for these screen fabrics and sieving nets have been developed.

For instance, Patent Literature 1 discloses a sieving net having excellent sieving efficiency. Regarding the sieving net disclosed in this literature, a rugged layer including binder components and inorganic fine particles covered with a silane monomer is formed on the surface of a base material constituting a main body of the sieving net as well as the arithmetic average roughness Ra of the surface of the rugged layer is 5 nm or more and 100 nm or less. When the arithmetic average roughness of the surface of the rugged layer is set to the above-mentioned prescribed value, the area of contact between powder and the base material is small and attachment of the powder to the base material is reduced. This prevents clogging of opening portions through which the powder passes, thereby increasing the powder sifting efficiency.

Patent Literature 2 discloses a technology in which an amorphous carbon film layer is formed on a main body of a printing mesh and a water repellent layer or a water- and oil-repellent layer is formed on the amorphous carbon film layer, so that the demoldability of a printing paste from the mesh can be improved. In addition, in this technology, use of the amorphous carbon film layer containing, as main components, carbon (C), hydrogen (H), and silicon (Si) makes it possible to increase adhesion to an emulsion.

Patent Literature 3 discloses a technology for providing a screen printing plate which can form a fine paste bump with high accuracy, in which a first layer member of a metal material, which is bored with first holes, and a second layer member of a resin material, which is bored with second holes having a diameter larger than that of the first holes, are layered. In this technology, inclusion of inorganic and/or organic fillers in the second layer member makes it possible to increase the mechanical and physical strength.

Patent Literature 4 discloses a technology for securing the binding strength in a resin sheet containing dispersed short fibers by removing only a resin portion from a part of the resin sheet while the short fibers are left in the resin sheet. In this technology, carbon nanotubes have been used as the short fibers.

In addition, Patent Literature 5 discloses a technology in which a second emulsion cured harder than a first emulsion is formed outwardly of the first emulsion formed on an inner gauge. In this technology, the hardness of each emulsion is adjusted by adjusting the content of poly-vinyl alcohol (filler) in each of the first emulsion or the second emulsion.

CITATION LIST

Patent Literature

Patent Literature 1: JP 2010-188294 A
Patent Literature 2: JP 5802752

Patent Literature 3: JP 2014-108617 A
Patent Literature 4: JP 2013-248828 A
Patent Literature 5: JP 2010-042612 A

SUMMARY OF INVENTION

Technical Problem

Sieving nets used in sieves sometimes have a static charge when repeatedly coming into contact with powder at the time of sieving. When the sieving nets have a static charge, powder attaches to the sieving nets and powder aggregates. As a result, the powder is hard to pass through the sieving nets. Because of this, sieving nets with a less static charge are demanded.

In addition, screen fabrics used in screen printing plates sometimes also have a static charge when screen printing is repeated (contact with a squeegee is repeated). When the screen fabrics have a static charge, ink transferred to a printed material bleeds and/or splashes. Further, screen fabrics may have a static charge while each screen fabric is stretched on a printing plate frame. When the screen fabric has a static charge during such a process, an adhesive and/or a contaminant such as dust or dirt may attach to the screen fabric. Because of this, screen fabrics with a less static charge are demanded.

It is an object of the present invention to provide a mesh member such that a static charge is suppressed.

Solution to Problem

The invention is summarized as follows.

[1] A mesh member including a mesh woven fabric and a coating layer that is formed on a surface of the mesh woven fabric and contains a carbon nanotube and/or graphene.

[2] The mesh member according to [1], wherein the carbon nanotube is a single-wall carbon nanotube.

[3] The mesh member according to [1] or [2], wherein the coating layer has a thickness of 0.1 μm or more and 1.0 μm or less.

[4] The mesh member according to any one of [1] to [3], wherein the coating layer has a volume resistivity of 0.01 Ω·cm or more and $1\times10^8$ Ω·cm or less.

[5] The mesh member according to any one of [1] to [4], wherein the mesh member is a sieving net.

[6] A sieve including the mesh member used according to [5].

[7] The mesh member according to any one of [1] to [4], wherein the mesh member is a screen fabric.

[8] A screen printing plate including the mesh member used according to [7].

Advantageous Effects of Invention

The invention can provide a mesh member such that a static charge is suppressed.

DESCRIPTION OF EMBODIMENTS

Figure 1:
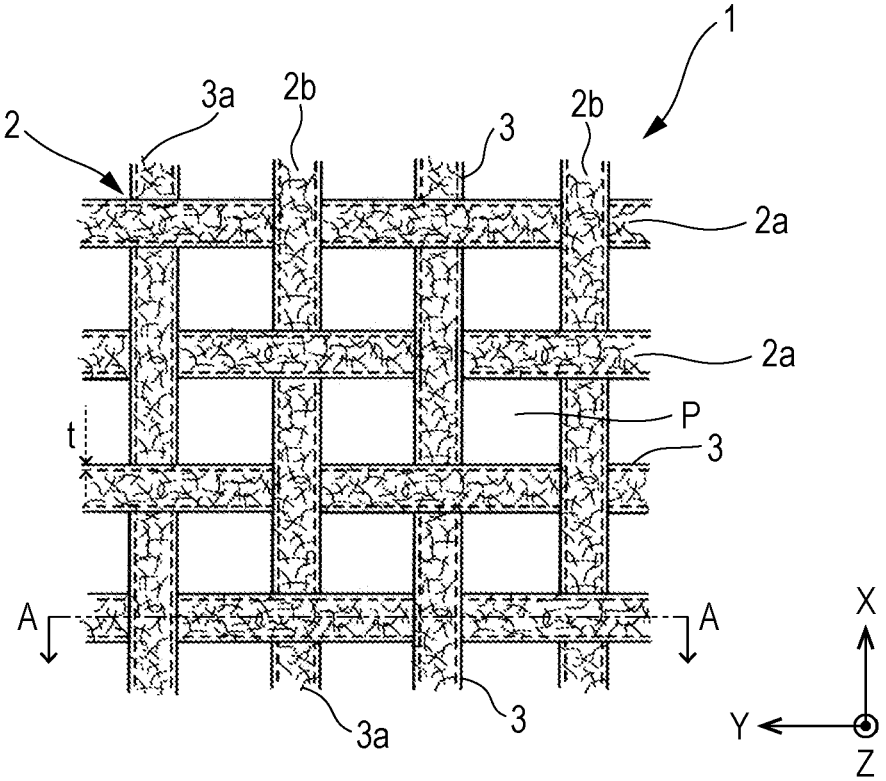
FIG. 1 is a schematic view of a sieving net.

Hereinbelow, embodiments of the invention will be described. A mesh member according to an embodiment of the invention includes a mesh woven fabric and a coating layer that is formed on a surface of the mesh woven fabric, and the coating layer contains a carbon nanotube and/or graphene. In the mesh member as so structured according to this embodiment, a static charge can be suppressed.

Here, in this embodiment, the mesh woven fabric refers to a woven fabric that can be obtained by weaving fibers in a given weave and has pores (through holes) between the fibers. In addition, in this embodiment, the mesh member refers to a member which is formed of a mesh woven fabric and in which a plurality of pores (through holes) disposed on the mesh woven fabric are kept without being blocked. Note that the mesh member is not necessarily formed of only a mesh woven fabric and may include an additional structure such as the below-described coating layer.

Specific examples of the mesh member include sieving nets used in sieves and screen fabrics used for screen printing plates. Hereinbelow, an embodiment (a first embodiment) where the mesh member is a sieving net and an embodiment (a second embodiment) where the mesh member is a screen fabric will be described.

First Embodiment

This embodiment is an embodiment where the mesh member is a sieving net. The sieving net in this embodiment has a net body and a coating layer formed on the surface of the net body. Note that the net body corresponds to the above-mentioned mesh woven fabric (woven fabric that can be obtained by weaving fibers in a given weave and has pores (through holes) between the fibers).

Material (fibers) as a component of the net body may be those used to form the below-described coating layer on their surface. Examples of such a material include fibers produced from various resins, synthetic fibers, natural fibers such as cotton, hemp and silk, and fibers produced from inorganic materials such as glass, ceramics and metals. One or two or more of these materials may be used in combination, and different materials may be used to construct a surface layer portion and a center portion of the net body-constituting fiber.

Examples of the various resins include synthetic resins and natural resins. Examples include: thermoplastic resins such as polyethylene resin, polypropylene resin, polystyrene resin, ABS resin, AS resin, EVA resin, polymethylpentene resin, polyvinyl chloride resin, polyvinylidene chloride resin, polymethyl acrylate resin, polyvinyl acetate resin, polyamide resin, polyimide resin, polycarbonate resin, polyethylene terephthalate resin, polybutylene terephthalate resin, polyacetal resin, polyarylate resin, polysulfone resin, polyvinylidene fluoride resin, Vectran (registered trademark), PTFE; biodegradable resins such as polylactic acid resin, polyhydroxybutyrate resin, modified starch resin, polycaprolacto resin, polybutylene succinate resin, polybutylene adipate terephthalate resin, polybutylene succinate terephthalate resin, polyethylene succinate resin; thermosetting resins such as phenol resin, urea resin, melamine resin, unsaturated polyester resin, diallyl phthalate resin, epoxy resin, epoxy acrylate resin, acrylic urethane resin, urethane resin; elastomers such as polystyrene elastomer, polyethylene elastomer, polypropylene elastomer, polyurethane elastomer; and natural resins such as lacquer.

The shape and the size of pores disposed on the net body (pores provided between fibers) may be selected, if appropriate, in accordance with a powder sieving procedure. For instance, in the case of sieving only particles with a specific size from particles as a component of powder, the net body may be provided with pores with a size through which only the particles with a specific size can pass. In addition, in the case of sieving only particles with a specific shape from particles as a component of powder, the net body may be provided with pores with a shape through which only the particles with a specific shape can pass.

The surface of the net body has a coating layer. The coating layer makes it possible to suppress a static charge of the sieving net if the coating layer is formed on at least part of the surface of the net body. In addition to the static charge suppression, to increase powder sieving efficiency, the coating layer may be formed at a powder contact position on the surface of the net body. From the viewpoints of suppressing a static charge and further increasing the powder sieving efficiency, the coating layer is preferably formed on the entire surface of the net body.

The coating layer formed on the surface of the net body contains a carbon nanotube and/or graphene.

The carbon nanotube is a structure in which a graphene sheet, which formed by bonding six-membered rings composed of carbon atoms to one another in a plane, is wound into a tubular shape. Examples of the carbon nanotube include: a single-wall carbon nanotube (SWNT) produced by winding one graphene sheet; a double-wall carbon nanotube (DWNT) produced by winding two graphene sheets into a concentric circle shape; or a multi-wall carbon nanotube (MWNT) produced by winding three or more graphene sheets into a concentric circle shape. Among these carbon nanotubes, it is preferable to use a single-wall carbon nanotube. In the case of using a single-wall carbon nanotube, even when the content of carbon nanotube is small, a static charge is less likely to occur and the sieving efficiency is more likely to increase than in the case of using a double-wall carbon nanotube or a multi-wall carbon nanotube. This makes it easy to maintain transparency of the coating layer when the single-wall carbon nanotube is used. In addition, it is particularly preferable that the surface of the carbon nanotube has a hydroxyl group (—OH group) after oxidizing treatment. The coating layer may be dried and solidified while the carbon nanotube is dispersed in the coating layer. In this case, because a hydroxyl group is included, tight adhesion between the coating layer and the net body is increased, leading to an increase in the durability. In addition, depending on the kind of the below-described binder, a coating layer with excellent strength and durability can be obtained by a dehydrative condensation reaction of a hydroxyl group on the carbon nanotube surface with a hydroxyl group of the binder component by, for instance, electron beam cross-linking.

The content of carbon nanotube with respect to 100 mass % of the coating layer is, for instance, 0.05 mass % or more and 10 mass % or less, preferably 0.3 mass % or more and 3.0 mass % or less, more preferably 0.5 mass % or more and 3.0 mass % or less, and particularly preferably 0.5 mass % or more and 1.0 mass % or less. The upper limit of the content of carbon nanotube is preferably 3.0 mass % or less from the viewpoints of suppressing a change in physical property of the coating layer (e.g., a decrease in strength of the coating layer) and a decrease in tight adhesion between the coating layer and the net body. The lower limit of the content of carbon nanotube is preferably 0.3 mass % or more from the viewpoints of suppressing a static charge and increasing sieving efficiency.

When a single-wall carbon nanotube is used as the carbon nanotube, in particular, the content of the single-wall carbon nanotube is preferably 0.3 mass % or more and 2.0 mass % or less. When the content of single-wall carbon nanotube is from 0.3 mass % or more and 2.0 mass % or less, a change in physical property of the coating layer (e.g., a decrease in strength of the coating layer) and a decrease in tight adhesion between the coating layer and the net body can be suppressed. In addition, a static charge can be further suppressed when compared to the case of using a multi-wall carbon nanotube, the content of which is within the above range. Further, when the content of single-wall carbon nanotube is within the above range (from 0.3 mass % to 2.0 mass %), it is easier to keep transparency of the coating layer.

The length and/or the diameter of carbon nanotube is not particularly limited. The diameter of carbon nanotube may be, for instance, 0.4 nm or more and 6 nm or less. In addition, the length of carbon nanotube may be from 1 μm or more and 1000 μm or less and further 1 μm or more and 50 μm or less. Note that the diameter and/or the length of carbon nanotube may be measured under a transmission electron microscope (TEM).

Carbon nanotubes may be produced by, for instance, an arc discharge process, laser vaporization process, or thermal decomposition process as described in, for instance, "Carbon Nanotube no Kiso (Basics of Carbon Nanotubes)" (published by CORONA PUBLISHING CO., LTD., 1998, p 23-p 57) by Saito and Bando. In addition, to increase purity, a hydrothermal method, a centrifugation method, an ultrafiltration method, or an oxidation method may be used for purification. Note that as the carbon nanotubes, it is possible to use commercially available carbon nanotubes.

Graphene is a structure formed by bonding six-membered rings composed of carbon atoms to one another in a plane. As the graphene, it is preferable to use reduced graphene oxide from the viewpoint of providing sufficient conductivity such that a static charge can be further suppressed. The process for producing graphene is not particularly limited, and a known procedure may be used for the production. Meanwhile, reduced graphene oxide is those prepared by reducing graphene oxide having an oxygen functional group (oxygen-containing functional group) on the surface and, for instance, produced by a procedure disclosed in WO 2014/112337.

The content of graphene with respect to 100 mass % of the coating layer is, for instance, 0.5 mass % or more and 5.0 mass % or less and preferably 0.5 mass % or more and 3.0 mass % or less. The case where the content of graphene is 0.5 mass % or more exerts a larger antistatic effect than the case where the content is less than 0.5 mass %. In addition, when the content of graphene is 5.0 mass % or less, it is easier to keep transparency of the coating layer than in the case where the content exceeds 5.0 mass %.

A procedure for fixing the coating layer onto the surface of the net body is not particularly limited. For instance, inclusion of a binder in the coating layer makes it possible to fix the coating layer onto the surface of the net body.

Examples of the binder include resins such as acrylic resin, polyester resin, polyurethane resin, phenol resin, epoxy resin, acrylic urethane resin, and vinyl ester resin. When the binder is included in the coating layer, the coating layer is easily fixed onto the surface of the net body and the carbon nanotube and/or graphene is unlikely to be detached from the coating layer. From the viewpoint of enhancing tight adhesion between the net body and the coating layer, the binder is preferably an acrylic resin and/or a polyester resin. Note that one or two or more kinds of binder may be used in combination. For instance, a first binder may be disposed on the surface of the net body and a second binder, which differs from the first binder, may be disposed on the surface of the first binder to yield the coating layer.

The content of the binder with respect to 100 mass % of the coating layer may be 80 mass % or more and 99.5 mass % or less and is preferably 90 mass % or more and 98 mass % or less from the viewpoints of enhancing tight adhesion between the net body and the coating layer and keeping physical property of the binder (e.g., strength of the coating layer).

The coating layer may include, in addition to the carbon nanotube and/or graphene and the binder, an additional component(s) such as a surfactant and/or a cross-linker.

Examples of the surfactant include nonionic surfactants such as glycerin fatty acid ester, polyoxyethylene, and alkyl polyglucoside, and anionic surfactants such as sodium dodecyl sulfate and sodium deoxycholate. Inclusion of the surfactant into the coating layer makes it possible to improve wettability of the coating layer (raw material for the coating layer) over the net body, so that a coating layer with a uniform thickness is likely to be formed. Among the surfactants, it is preferable to use a nonionic surfactant. The case where a nonionic surfactant is included in the coating layer allows for a coating layer with higher carbon nanotube and/or graphene dispersibility and more uniform than the case where an anionic surfactant is included in the coating layer.

The content of the surfactant with respect to 100 mass % of the coating layer may be 0.01 mass % or more and 2.0 mass % or less and is preferably 0.1 mass % or more and 1.0 mass % or less from the viewpoints of enhancing wettability of the coating layer (raw material for the coating layer) over the net body and keeping physical property of the coating layer (e.g., strength of the coating layer).

Examples of the cross-linker include an isocyanate group-containing/isocyanate-based cross-linker, an oxazoline group-containing/oxazoline-based cross-linker, a carbodiimide group-containing/polycarbodiimide-based cross-linker, or an amine-based-compound-containing/amine-based cross-linker. At the time of using each cross-linker, a UV light, electron bean, or X-ray cross-linking procedure, for instance, may be used. When a cross-linker is included in the binder (e.g., an electron beam curable resin, UV curable resin), the binder is cross-linked. When the binder is cross-linked, the strength of the coating layer is improved. As a result, the coating layer wear and/or detachment, which are caused by contact between the coating layer and, for instance, powder, can be suppressed. This can reduce what is called contamination in which the coating layer and/or substances included in the coating layer are mixed in the powder. When the binder is cross-linked, it is possible to suppress release of substances included in the coating layer to the outside of the coating layer and to reduce up-take of substances in contact with the coating layer (e.g., substances included in a solvent capable of being used during manufacture of a sieving net, substances included in powder to be sieved) into the coating layer. This can suppress a change in physical property of the coating layer (e.g., volume resistivity of the coating layer) during manufacture and/or during powder sieving. Thus, this makes it easier to keep a state in which a static charge is suppressed. In addition, the above makes it easier to keep a state in which powder sieving efficiency is increased.

The content of the cross-linker with respect to 100 mass % of the coating layer may be, for instance, 0.5 mass % or more and 20 mass % or less and is preferably 1.0 mass % or more and 10 mass % or less from the viewpoints of reducing a change in physical property of the coating layer (e.g., volume resistivity of the coating layer).

The thickness of the coating layer is preferably 0.1 μm or more and 1.0 μm or less and more preferably 0.1 μm or more and 0.5 μm or less. When the thickness of the coating layer is 0.1 μm or more, the coating layer is more easily held on the surface of the net body than in the case where the thickness of the coating layer is less than 0.1 μm. In addition, when the thickness of the coating layer is 1.0 μm or less, pores provided on the net body are more unlikely to be blocked than in the case of more than 1.0 μm. For instance, when the thickness of the coating layer is 1.0 μm or less, a resin burr, which affects aperture, can be suppressed. As a result, pores provided on the net body are unlikely to be blocked. The thickness of the coating layer is a value calculated by measuring, using sieving net cross-sections at three or more arbitrary points of the sieving net, the respective thicknesses of the coating layer under a scanning electron microscope (SEM) and by adding and averaging the measured thicknesses of the coating layer.

The volume resistivity of the coating layer is preferably 0.01 Ω·cm or more and $1\times10^8$ Ω·cm or less, more preferably 0.01 Ω·cm or more and $1\times10^5$ Ω·cm or less, and particularly preferably 1 Ω·cm or more and $1\times10^4$ Ω·cm or less. Note that the volume resistivity within a range from 0.01 Ω·cm or more to $1\times10^8$ Ω·cm or less may be further selected such that a further preferable range is obtained in accordance with the kind of powder and/or sieving conditions. In addition, the volume resistivity within a range from 0.01 Ω·cm or more to $1\times10^8$ Ω·cm or less may be further selected in accordance with the thickness of the coating layer. For instance, when the thickness of the coating layer is 1 μm, the volume resistivity is preferably 0.1 Ω·cm or more and $1\times10^3$ Ω·cm or less. When the thickness of the coating layer is 0.1 μm, the volume resistivity is preferably 0.01 Ω·cm or more and $1\times10^4$ Ω·cm or less. When the volume resistivity of the coating layer is 0.01 Ω·cm or higher, the content of carbon nanotube and/or graphene is smaller than that in the case where the volume resistivity is less than 0.01 Ω·cm. As a result, it is easier to keep transparency of the coating layer. In addition, the content of carbon nanotube and/or graphene is small. Thus, the physical property of the coating layer is unlikely to be changed (e.g., the strength of the coating layer is unlikely to be decreased) and tight adhesion between the coating layer and the net body is also unlikely to be lowered. In addition, when the volume resistivity of the coating layer is $1\times10^8$ Ω·cm or less, the antistatic performance is more easily elicited than in the case where the volume resistivity exceeds $1\times10^8$ Ω·cm. This makes it easier to improve sieving efficiency. The volume resistivity of the coating layer may be adjusted by, for instance, changing the content of carbon nanotube and/or graphene contained in the coating layer. Note that generally speaking, as the volume resistivity becomes lower, a static charge is more unlikely to occur.

The volume resistivity of the coating layer may be calculated using the following formula (1).

$$\rho_v=\rho_s\times t \tag{1}$$

In the above formula (1), $\rho_v$ represents the volume resistivity (Ω·cm) of the coating layer; $\rho_s$ represents the surface resistivity (Ω/□) of the coating layer; and t represents the thickness (cm) of the coating layer.

Meanwhile, the volume resistivity $\rho_s$ of the coating layer is a value measured in accordance with JISK7194 (in the year 1994). The thickness t of the coating layer is a value calculated by measuring, using sieving net cross-sections at three or more arbitrary points of the sieving net, the respective thicknesses of the coating layer under a scanning electron microscope (SEM) and by adding and averaging the measured thicknesses of the coating layer.

A sieving net in this embodiment may be used as a sieve after fixed to a sieve frame by a conventionally known procedure. As the sieve frame, it is possible to use a conventionally known one, and for instance, a tubular member structured using material such as a metal, casting, resin, or lumber can be used as a printing plate frame.

Powder to be sieved using a net body in this embodiment is not particularly limited. Examples include starch powder, silica, powder coating, toner, battery material, or copper powder. The particle size of particles constituting the powder is not particularly limited, and for instance, the volume-average particle size may be 1 μm or more and 1000 mm or less. Note that the volume-average particle size refers to a particle size measured as a median diameter (D50) in terms of volume by laser diffraction scattering.

Figure 2:
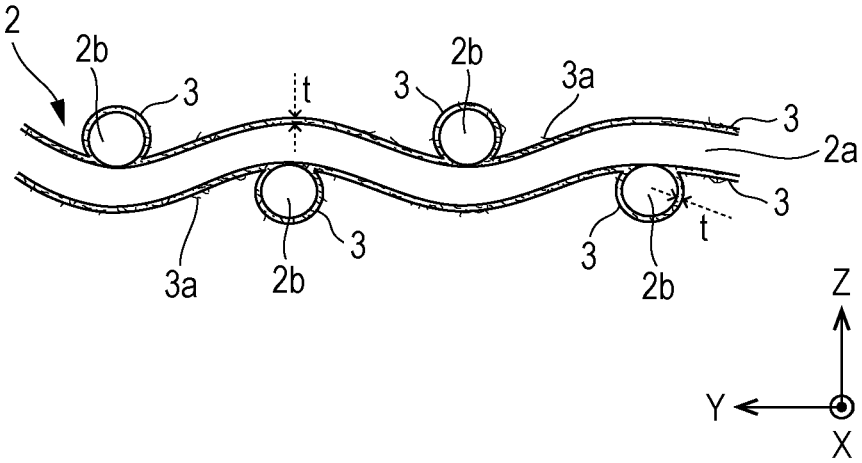
FIG. 2 is a cross-section view of the sieving net.

Here, one example of the specific structure of a sieving net in this embodiment will be illustrated using FIG. 1 and FIG. 2. FIG. 1 is a schematic view of a sieving net 1 in this embodiment, and FIG. 2 is a cross-section view cut along A-A of the sieving net 1 shown in FIG. 1. Note that the composition and/or the physical property of the net body 2 or the coating layer 3 have been described above, and the detailed description is thus omitted. Meanwhile, the x-axis and the y-axis are orthogonal to each other, and the z-axis is orthogonal to both the x-axis and the y-axis. The relationship among the x-axis, the y-axis, and the z-axis is likewise defined in FIGS. 5 to 7 as described below.

As shown in FIG. 1 and FIG. 2, the sieving net 1 in this embodiment has a net body 2 and a coating layer 3 formed on the surface of the net body 2. Note that because the coating layer 3 is formed on the surface of the net body 2, the net body 2 is depicted using dashed lines in FIG. 1.

The net body 2 is composed of a plurality of wefts 2*a* and a plurality of warps 2*b*. The plurality of wefts 2*a* are arranged in parallel on an X-Y plane with a given interval, and the plurality of warps 2*b* are arranged perpendicular to the wefts 2*a* on the X-Y plane and in parallel with a given interval. The plurality of wefts 2*a* and the plurality of warps 2*b* are each alternately positioned up and down in the z-axis direction and constitute a weave of a plain fabric. Note that the weave of the net body 2 is not particularly limited, and a twill weave or a sateen weave may be used.

The diameter of the wefts 2*a* or the warps 2*b* of the sieving net 1 in this embodiment and the aperture ratio (ratio of the area of pores P in the X-Y plane to the area (including the area of pores P) of the net body 2 in the X-Y plane) may be selected, if appropriate, depending on the kind of powder, the particle size of particles constituting powder, and/or operating environment. For instance, the diameter of the wefts 2*a* or the warps 2*b* may be 20 μm or more and 1000 μm or less, and the aperture ratio may be 5% or more and 90% or less.

Each pore P is formed in a space defined by two adjacent wefts 2*a* and two adjacent warps 2*b*. At least part of particles constituting powder can pass through the pores P. The shape and size of the pores P may be selected, if appropriate, in accordance with a powder sieving procedure. For instance, the height in the x-axis direction and the width in the y-axis direction of each pore P may be 20 μm or more and 1000 μm or less.

The surface of the net body 2 (i.e., the surfaces of the wefts 2*a* and the warps 2*b*) is covered with the coating layer 3 containing a binder and a carbon material 3*a* as shown in FIG. 1 and FIG. 2. The binder included in the coating layer 3 is used to fix the carbon material 3*a* to the coating layer 3 and the coating layer 3 to the surface of the net body 2. The carbon material 3*a* included in the coating layer 3 is a carbon nanotube and/or graphene, and is fixed to the binder while a portion thereof is exposed from the binder and/or while the whole is incorporated inside the binder as shown in FIG. 2. The coating layer 3 may contain, in addition to the binder and the carbon material 3*a*, a cross-linker and/or a surfactant.

The coating layer 3 has a thickness t. The thickness t is not particularly limited, and may be selected, if appropriate, because of a change in the size and/or the shape of the pores P in accordance with the thickness t of the coating layer 3, such that powder can pass through a sieve after the change is considered.

In the above-describe sieving net in this embodiment, the surface of the net body has a carbon nanotube- and/or graphene-containing coating layer. In the sieving net including this coating layer, a static charge of the sieving net can be suppressed. Consequently, in the sieving net in this embodiment, powder attachment can be suppressed as well as powder aggregation can be reduced. This can thus prevent pores provided on the net body from being blocked, so that powder passes easily through the pores formed on the net body. That is, this embodiment makes it possible to provide a sieving net such that a static charge can be suppressed and powder sieving efficiency is excellent. In addition, in the sieving net in this embodiment, a static charge is unlikely to occur even if contact with powder lasts, and as a result of which it is possible to keep a state in which powder sieving efficiency is increased.

Besides, in the sieving net in this embodiment, the sieving efficiency can be improved without including any substance, such as a heavy metal, harmful to a human body in the coating layer formed on the surface of the net body. This can not only increase the sieving efficiency, but also makes it easier to prevent what is called contamination in which a substance harmful to a human body is mixed in powder.

Next, a method of producing a sieving net according to an embodiment of the invention will be described.

Figure 3:
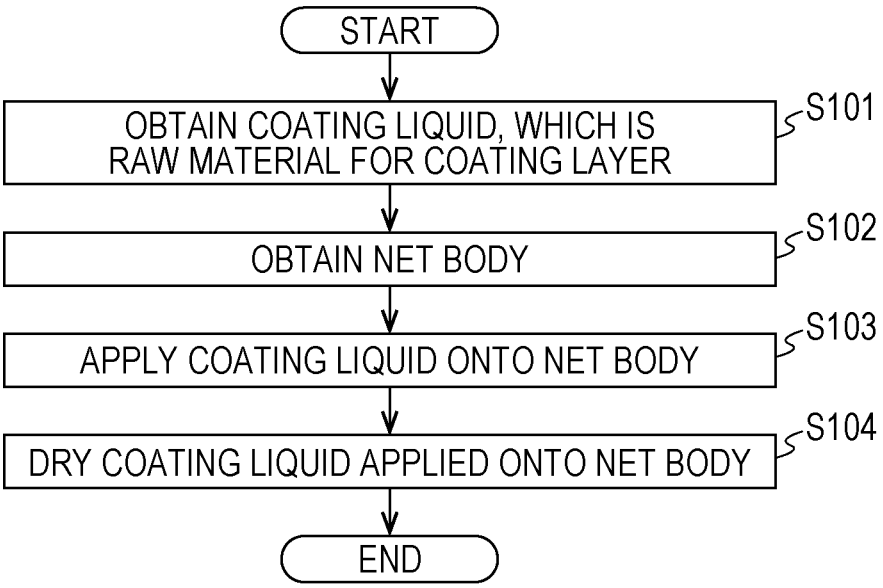
FIG. 3 is a flowchart illustrating a first method of producing a sieving net.

First, the first production method will be described using FIG. 3.

At step S101, a coating liquid, which is a raw material for a coating layer, is obtained. The coating liquid may be obtained by mixing a carbon nanotube and/or graphene with a solvent. The mixing procedure is not particularly limited, and conventionally known procedures may be used. When the coating layer includes a component(s), such as a binder, a cross-linker, and/or a surfactant, other than the carbon nanotube and/or graphene, the component(s) may be included in the coating liquid. Examples of a solvent used for the coating liquid include water, methanol, ethanol, toluene, acetone, or methyl ethyl ketone.

At step S102, a net body is obtained. The net body may be obtained by weaving yarns (fibers) such that pores (through holes) are formed between the fibers.

The net body obtained in step S102, as it is, may be subject to treatment at step S103 described below, or may be subject to pre-treatment prior to the treatment at step S103 such that the coating liquid obtained in step S101 is easily and tightly bonded to the surface of the net body. Examples of the pre-treatment include corona discharge treatment, plasma discharge treatment, flame treatment, or hydrophilic treatment with an oxidizing acid aqueous solution of chromic acid or perchloric acid, and/or an alkaline aqueous solution containing sodium hydroxide.

At step S103, the coating liquid obtained after the treatment at step S101 is applied onto the net body obtained after the treatment at step S102. Examples of a process for applying the coating liquid onto the net body include dip coating, spray coating, micro gravure coating, or gravure coating. Two or more of these processes may be used in combination.

At step S104, the coating liquid applied onto the net body after the treatment at step S103 is dried. A solvent is removed by drying the coating liquid to form a coating layer on the surface of the net body. The coating liquid drying process may be set, if appropriate, depending on a material(s) for the net body and/or a component(s) of the coating liquid. Examples include a drying process using warm air or hot air.

The sieving net in this embodiment can be produced through the treatments at steps S101 to S104 as described above. Note that in the first production method, the order of treatments in steps S101 and S102 is not particularly limited, and the treatment at step S102 may be followed by the treatment at step S101 or these treatments may be carried out simultaneously.

Figure 4:
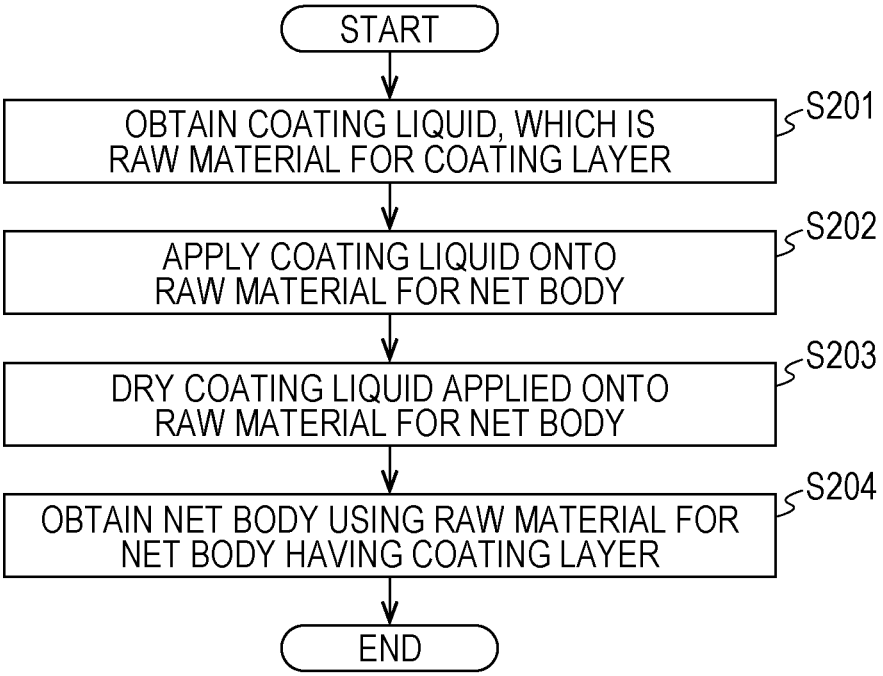
FIG. 4 is a flowchart illustrating a second method of producing a sieving net.

Next, the second production method will be described using FIG. 4.

At step S201, a coating liquid, which is a raw material for a coating layer, is obtained. The coating liquid acquiring process is the same as in step S101 of the first production method, and the detailed description is thus omitted.

At step S202, the coating liquid is applied onto fibers, which is a raw material for a net body. The raw material (fibers) for the net body may be subject to pre-treatment prior to the treatment at step S202 such that the coating liquid obtained after the treatment in step S201 is easily and tightly bonded to the surface of the raw material (fibers) for the net body. Note that the coating liquid application process is the same as in step S103 of the first production method, and the pre-treatment is the same as the pre-treatment of the net body in the first production method. Thus, the detailed description is omitted.

At step S203, the coating liquid applied onto the raw material (fibers) for the net body is dried. A solvent is removed by drying the coating liquid to form a coating layer on the surface of the raw material for the net body. The coating liquid drying process is the same as in step S104 of the first production method, and the detailed description is thus omitted.

At step S204, the net body is obtained using the raw material (fibers) for the net body on which the coating layer is formed. Specifically, yarns (fibers) are weaved such that pores (through holes) are formed between the fibers.

The sieving net in this embodiment can be produced through the treatments at steps S201 to S204 as described above.

Note that a sieve may be manufactured by fixing the sieving net in this embodiment to a sieve frame by a known technique. To fix the sieving net to the sieve frame, an adhesive, for instance, may be used.

Second Embodiment

Next, an embodiment, where the mesh member is a screen fabric, will be described.

A screen fabric in this embodiment includes a mesh woven fabric and a coating layer that is formed on a surface of the mesh woven fabric, and the coating layer contains a carbon nanotube and/or graphene. In this embodiment, the net body (mesh woven fabric) and/or the coating layer, as described in the first embodiment, may be used for the above mesh woven fabric and coating layer.

Figure 5:
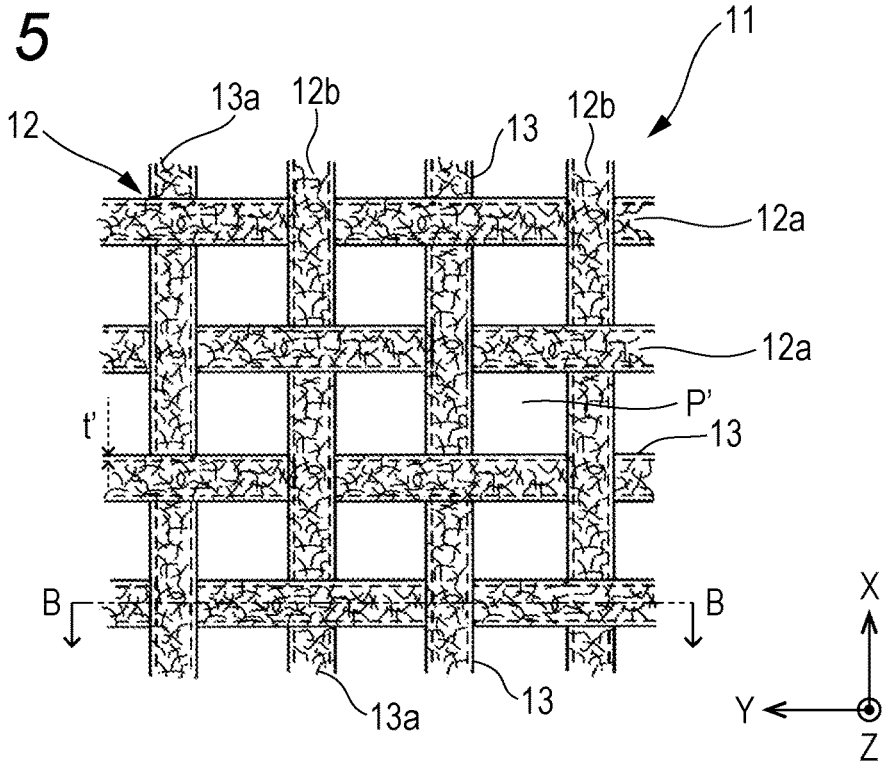
FIG. 5 is a schematic view of a screen fabric.
Figure 6:
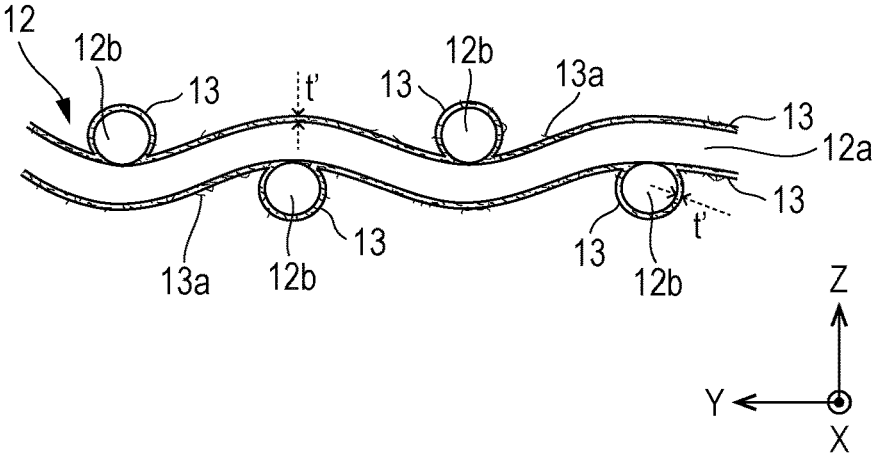
FIG. 6 is a cross-section view of the screen fabric.

Hereinbelow, one example of the specific structure of a screen fabric in this embodiment will be illustrated using FIG. 5 and FIG. 6. FIG. 5 is a schematic view of a screen fabric 11 in this embodiment, and FIG. 6 is a cross-section view cut along B-B of the screen fabric 11 shown in FIG. 5. Note that in the following description, the detailed description about the same elements as in the first embodiment is omitted.

The screen fabric 11 in this embodiment has a mesh woven fabric 12 and a coating layer 13 formed on the surface of the mesh woven fabric 12.

The mesh woven fabric 12, like the net body 2 (the net body in the first embodiment) shown in FIG. 1, has a plurality of wefts 12*a* and a plurality of warps 12*b* and constitutes a weave of plain fabric. Note that the weave of the mesh woven fabric 12 is not particularly limited.

Any material (fibers) as a component of the plurality of wefts 12*a* and the plurality of warps 12*b* is allowed as long as the coating layer 13 can be formed on their surface. The material described in the first embodiment may be used. For instance, synthetic fiber(s) may be used as the material (fibers) constituting the wefts 12*a* and the plurality of warps 12*b*. Examples of the synthetic fiber that can be used include synthetic fiber formed from polyethylene terephthalate (PET), polybutylene terephthalate (PBT), polyethylene naphthalate (PEN), polyester such as liquid crystal polyester, nylon, polyphenyl sulfone (PPS), or polyether ether ketone (PEEK). Two or more kinds of these fibers may be used in combination.

Each pore P' is formed in a space defined by two adjacent wefts 12*a* and two adjacent warps 12*b*. During a screen printing process, some pores P' that are among the plurality of pores P' arranged on the screen fabric 11 and are each provided on a section having the below-described shielding film are blocked by the shielding film. In addition, ink is charged into and held in some pores P' that are among the plurality of pores P' arranged on the screen fabric 11 and are each provided on a section exposed from an opening formed on the shielding film. Then, the ink held in the pores P' is transferred to a material to be printed. In this way, screen printing is carried out. Like the net body 2 described in the first embodiment, the wefts 12*a* and the warps 12*b* may each have a diameter of, for instance, 20 μm or more and 1000 μm. Also, like the net body 2 described in the first embodiment, the mesh woven fabric 12 may have an aperture ratio of, for instance, 5% or more and 90% or less.

The surface of the mesh woven fabric 12 (the surfaces of the wefts 12*a* and the warps 12*b*) has the coating layer 13 containing a carbon material 13*a*. In the screen fabric 11, the coating layer 13 is formed on the entire surface of the mesh woven fabric 12. However, a static charge of the screen fabric 11 can be suppressed if at least part of the surface of the mesh woven fabric 12 has the coating layer 13. To increase precision of printing using the screen fabric 11 as well as to suppress a static charge, it is preferable that the coating layer 13 is formed on at least a section of the mesh woven fabric 12 exposed from an opening formed on a shielding film.

The carbon material 13*a* included in the coating layer 13 is a carbon nanotube and/or graphene. The carbon nanotube and graphene have been described in the first embodiment, and the detailed description is thus omitted.

Here, an opening of the below-described shielding film formed on the screen fabric 11 may be formed by, for instance, irradiating, with UV light, a specific section of a resin layer (layer including a photosensitive resin) formed on the surface of the screen fabric 11 and then by removing a section that has not been irradiated with UV light. Thus, when the reflectivity of ultraviolet (UV) light on the screen fabric 11 is too high, irregular reflection of light is likely to occur. Then, a section other than a target section in the resin layer is irradiated with reflected light (UV light). As a result, the precision of forming an opening of the shielding film may decrease. However, in the screen fabric 11 in this embodiment, the coating layer 13 containing the carbon material 13*a* is formed on the mesh woven fabric 12, thereby capable of suppressing irregular reflection of light. Accordingly, the precision of forming an opening of the shielding film is more likely to increase in the screen fabric 11 in this embodiment than in a screen fabric 11 without the coating layer 13.

Meanwhile, when the reflectivity of light on the screen fabric 11 is too low, irregular reflection of light on the screen fabric 11 is unlikely to occur. Then, formation of the shielding film may take long time. When the formation of the shielding film takes long time, the productivity of screen printing plate is likely to decrease. When the coating layer 13 is colored, the reflectivity of light on the screen fabric 11 is significantly lowered. As a result, irregular reflection of light on the screen fabric 11 is unlikely to occur and the productivity of screen printing plate is likely to decrease. Thus, it is preferable that in the screen fabric 11 in this embodiment, the coating layer 13 has transparency. It is easier to keep transparency of the coating layer 13 in the case of using a single-wall carbon nanotube as the carbon material 13*a* than in the case of using a multi-wall carbon nanotube. Accordingly, it is preferable to use a single-wall carbon nanotube as the carbon material 13*a*. For instance, the transparency can be kept if the concentration of the single-wall carbon nanotube is set such that the total light transmittance is 80% or more and less than 90% and more preferably 85% or more and less than 90%.

For instance, from the viewpoint of increasing the precision of forming an opening of the shielding film, the reflectivity of light on the screen fabric 11 is preferably set such that the light absorption rate at a peak wavelength of 375 nm is 8% or lower. Note that as used herein, the reflectivity of light on the screen fabric 11 refers to a ratio of the volume of light reflected by the screen fabric 11 and then emitted outside the screen fabric 11 (mesh woven fabric 12 having the coating layer 13) to the volume of light incident in the screen fabric 11 (mesh woven fabric 12 having the coating layer 13) from the z-axis direction, and may be measured using, for instance, a spectrophotometer (V-670, JASCO Corporation).

When the carbon material 13*a* is a carbon nanotube, the content of the carbon material 13*a* with respect to 100 mass % of the coating layer may be 0.05 mass % or more and 10 mass % or less, preferably 0.3 mass % or more and 3.0 mass % or less, more preferably 0.3 mass % or more and 2.0 mass % or less, and particularly preferably 0.5 mass % or more and 2.0 mass % or less. The upper limit of the content of the carbon material 13*a* (carbon nanotube) is preferably 3.0 mass % or less from the viewpoints of suppressing a change in physical property of the coating layer 13 (e.g., a decrease in strength of the coating layer 13) and suppressing a decrease in tight adhesion between the coating layer 13 and the mesh woven fabric 12. The lower limit of the content of the carbon material 13*a* (carbon nanotube) is preferably 0.3 mass % or higher from the viewpoint of sustaining antistatic performance.

When a single-wall carbon nanotube is used as the carbon material 13*a*, in particular, the content of the single-wall carbon nanotube is preferably 0.3 mass % or more and 2.0 mass % or less. When the content of single-wall carbon nanotube is from 0.3 mass % or more and 2.0 mass % or less, a change in physical property of the coating layer 13 and a decrease in tight adhesion between the coating layer 13 and the mesh woven fabric 12 can be suppressed. In addition, a static charge in the screen fabric 11 is likely to be continuously suppressed when compared to the case of using a multi-wall carbon nanotube, the content of which is within the above range. In addition, when the content of single-wall carbon nanotube is within the above range (from 0.3 mass % or more to 2.0 mass % or less), it is easier to keep transparency of the coating layer 13.

The length and the diameter of carbon nanotube is not particularly limited, and the carbon nanotube with a length and a diameter as described in the first embodiment may be used.

Meanwhile, when the carbon material 13*a* is graphene, the content of the carbon material 13*a* with respect to 100 mass % of the coating layer is, for instance, 0.5 mass % or more and 5.0 mass % or less and preferably 0.5 mass % or more and 3.0 mass % or less. When the content of the carbon material 13*a* (graphene) is 0.5 mass % or higher, an antistatic effect is larger than in the case where the content is less than 0.5 mass %. In addition, when the content of the carbon material 13*a* (graphene) is 5.0 mass % or less, it is easier to keep transparency of the coating layer than in the case where the content exceeds 5.0 mass %.

How to fix the coating layer 13 containing the carbon material 13*a* onto the surface of the mesh woven fabric 12 is not particularly limited, and a procedure for including a binder in the coating layer 13 may be used like the first embodiment. The component(s) and the content of the binder are the same as in the first embodiment, and the detailed description is thus omitted.

The coating layer 3 may contain, in addition to the carbon nanotube and the binder, an additional component(s) such as a surfactant and/or a cross-linker. The component(s) and the content of the surfactant or the cross-linker are the same as in the first embodiment, and the detailed description is thus omitted. Note that when the coating layer 13 contains a binder and a cross-linker, the binder included in the coating layer 13 is cross-linked. When the binder is cross-linked, inter-binder tight adhesion is increased. As a result, it is possible to suppress release of substances included in the coating layer 13 to the outside of the coating layer 13 and to reduce uptake of substances in contact with the coating layer 13 (e.g., a solvent capable of being used during manufacture of the screen fabric 11 and/or substances included in ink used during a screen printing process) into the coating layer 13. This can prevent a change in physical property (e.g., volume resistivity) of the coating layer 13 during manufacture and/or during printing. Thus, a static charge in the screen fabric 11 is more likely to be further continuously suppressed than in the case where any cross-linker is not included.

Like the first embodiment, the thickness t' of the coating layer 13 is preferably 0.1 μm or more and 1.0 μm or less and more preferably 0.1 μm or more and 0.5 μm or less.

The volume resistivity of the coating layer 13 is preferably 0.01 Ω·cm or more and $1\times10^8$ Ω·cm or less, more preferably 1 Ω·cm or more and $1\times10^8$ Ω·cm or less, and particularly preferably 1 Ω·cm or more and $1\times10^4$ Ω·cm or less. Regarding the volume resistivity of the coating layer 13, the volume resistivity within a range from 0.01 Ω·cm or more to $1\times10^8$ Ω·cm or less may be further selected in accordance with the thickness of the coating layer. For instance, when the thickness of the coating layer 13 is 1 μm, the volume resistivity is preferably 1 Ω·cm or more and $1\times10^8$ Ω·cm or less. When the thickness of the coating layer 13 is 0.1 μm, the volume resistivity is preferably 1 Ω·cm or more and $1\times10^7$ Ω·cm or less. When the volume resistivity of the coating layer 13 is 0.01 Ω·cm or higher, the content of the carbon material 13*a* is smaller than that in the case where the volume resistivity is less than 0.01 Ω·cm. As a result, it is easier to keep transparency of the coating layer 13. In addition, the content of the carbon material 13*a* is small. Thus, the physical property of the coating layer 13 is unlikely to be changed (e.g., the strength of the coating layer 13 is unlikely to be decreased) and tight adhesion between the coating layer 13 and the mesh woven fabric 12 is also unlikely to be lowered. In addition, when the volume resistivity of the coating layer 13 is $1\times10^8$ Ω·cm or less, a static charge, itself, in the screen fabric 11 is more easily prevented than in the case where the volume resistivity exceeds $1\times10^8$ Ω·cm. The volume resistivity of the coating layer 13 may be adjusted by, for instance, changing the content of the carbon material 13*a* contained in the coating layer 13.

The volume resistivity of the coating layer 13 may be calculated using the above formula (1).

Figure 7:
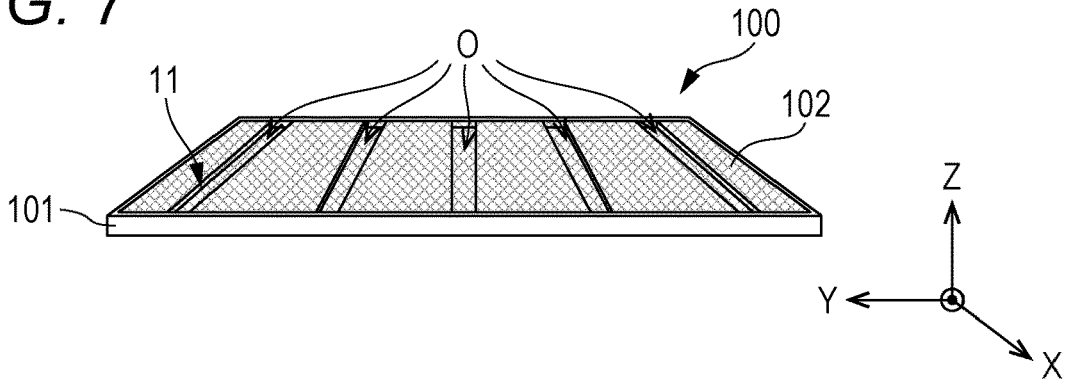
FIG. 7 is a schematic view of a screen printing plate.

As shown in FIG. 7, the screen fabric 11 in this embodiment may be used as one component member of a screen printing plate 100. The screen printing plate 100 is a member including: a printing plate frame 101, the screen fabric 11 stretched on the printing plate frame 101; and a shielding film 102 formed on the surface of the screen fabric 11.

The printing plate frame 101 is a rectangular frame and a member for holding the screen fabric 11 stretched at a prescribed tensile strength. Examples of an available material for the printing plate frame 101 include, but are not particularly limited to, a metal, casting, resin, or lumber. For instance, an adhesive may be used as a means for fixing the screen fabric 11 to the printing plate frame 101.

The shielding film 102 is a film for providing an opening O with a shape corresponding to a given printing pattern. The opening O penetrates through the shielding film 102 in the z-axis direction. Examples of an available raw material for the shielding film 102 include a photosensitive resin (photoresist) curable by light irradiation. As the photosensitive resin, it is possible to use, for instance, a diazo-based resin, a radical-based resin, or a stilbazolium-based resin. The photosensitive resin that can be used is not limited because of curing mechanisms. The thickness of the shielding film 102 may be set, if appropriate, in view of the film thickness in a printing pattern formed on a material to be printed.

When the screen printing plate 100 is used for screen printing, ink is charged into the opening O provided on the shielding film 102. Next, the ink is held by the screen fabric 11 arranged under the opening O. Then, a squeegee (not shown), for instance, is used to bring the screen fabric 11 into contact with a material to be printed. After that, the screen fabric 11 in contact with the material to be printed is made to detach from the material to be printed. Finally, the ink within the opening O is transferred to the material to be printed, and screen printing is carried out.

The screen fabric 11 in this embodiment as described above has the coating layer 13 containing the carbon nanotube 13*a* on the surface of the mesh woven fabric 12. The screen fabric 11 containing this coating layer 13 is unlikely to have a static charge even if screen printing is repeated. In addition, this antistatic effect can be maintained for a long period. This makes it possible to continuously prevent ink from bleeding and/or splashing due to a static charge on the screen fabric 11.

Like the first production method in the first embodiment, the screen fabric 11 in this embodiment can be produced by applying a coating liquid, which is a raw material for the coating layer, onto a mesh woven fabric and drying the coating liquid applied. In addition, in this embodiment, like the second production method in the first embodiment, a coating liquid, which is a raw material for the coating layer, is applied and dried on a raw material (fibers) for a mesh woven fabric to form the coating layer. Then, the raw material (fibers) for the mesh woven fabric having the coating layer may be used to form the mesh woven fabric for production.

Figure 8:
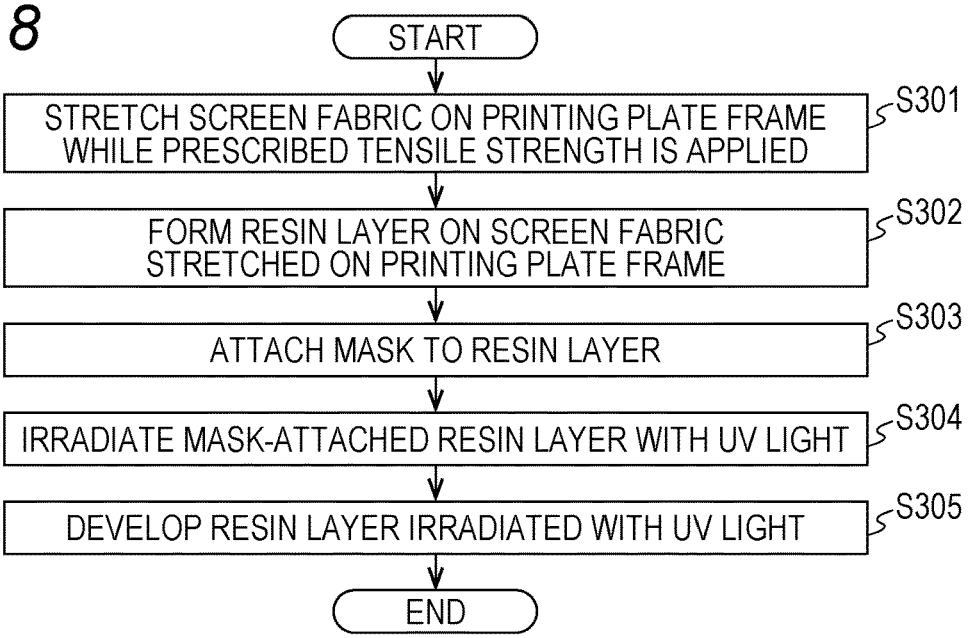
FIG. 8 is a flowchart illustrating a method of manufacturing a screen printing plate.

Next, FIG. 8 is used to describe how to obtain a screen printing plate using the screen fabric in this embodiment. Note that the method of manufacturing a screen printing plate is not limited to the below-described manufacturing method. Conventionally known procedures may be used therefor.

At step S301, a screen fabric in this embodiment is stretched on a printing plate frame while a prescribed tensile strength is applied. To stretch the screen fabric on the printing plate frame, a fabric tensioning device may be used. Specifically, portions of the screen fabric in the four side directions are held by respective clamps of the fabric tensioning device. Next, each clamp is stretched and adjusted, using mechanical/air pressure, at a prescribed tensile strength and at a given bias angle. Then, the screen fabric is fixed to the printing plate frame while the prescribed tensile strength is being applied. The prescribed tensile strength applied onto the screen fabric 11 may range from, for instance, 21 N/cm to 36 N/cm.

At step S302, a resin layer is formed on the surface of the screen fabric stretched on the printing plate frame. The resin layer undergoes the below-described treatments at steps S303 to S305 to constitute a shielding film. It is possible to use, for instance, the above-described photosensitive resin as the resin layer. The resin layer formation process is not particularly limited, and examples of the process that can be used include: a process for attaching a solid (e.g., film) photosensitive resin onto the surface of the screen fabric 11; or a process for applying a solvent-containing liquid photosensitive resin onto the surface of the screen fabric 11 and drying the resin to evaporate and remove the solvent. The thickness of the resin layer may be set, if appropriate, in view of the thickness of the above-described shielding film.

During treatment at step S303, a mask with a shape corresponding to a give printing pattern is attached onto the surface of the resin layer. Any mask is allowed if UV light penetration can be prevented. For instance, a film or glass may be used.

During treatment at step S304, the resin layer, to which the mask is attached, is irradiated with UV light. This causes the resin layer to be cured except sections where the mask prevents UV light irradiation.

During treatment at step S305, the resin layer is developed, and the mask and the sections (non-cured sections) that have not been irradiated with UV light in the resin layer are removed. Because the sections that have not been irradiated with UV light are removed, a shielding film having an opening with a shape corresponding to a give printing pattern is formed on the surface of the screen fabric.

The treatments at these steps S301 to S305 may be carried out to manufacture the screen printing plate.

EXAMPLES

Hereinafter, the invention is specifically described by referring to Examples. However, the invention is not restricted to just these Examples.

First, an Example, where the mesh member is a sieving net, will be described.

Example 1 (Sieving Net)

A polyester resin, an acrylic resin, a nonionic surfactant (WET 510, manufactured by Evonik Industries AG), a cross-linker (oxazoline-based cross-linker), and a single-wall carbon nanotube (with a length of 1 μm or more and 20 μm or less) were dispersed in water to prepare a carbon nanotube dispersion. This dispersion was mixed with water to prepare a coating liquid. Also provided were nylon fibers with a diameter of 50 μm. The fibers were used as warps and wefts and weaved into a plain fabric to produce a net body while the number of meshes (the number of yarns per inch) was 200 (yarns/inch). The resulting net body was subjected to corona treatment. The net body that underwent corona treatment was soaked into the coating liquid. In this way, the coating liquid was applied onto the net body. The coating liquid applied onto the net body was dried with hot air to form a coating layer on the surface of the net body. This net body having the coating layer was a sieving net in Example 1.

Example 2 (Sieving Net)

The same conditions as in Example 1 were used, except that the content of the single-wall carbon nanotube included in the coating liquid was changed and the contents of the polyester resin and the acrylic resin were changed, to produce a sieving net in Example 2.

Example 3 (Sieving Net)

The same conditions as in Example 1 were used, except that instead of the carbon nanotube dispersion included in the coating liquid, a carbon nanotube dispersion containing a multi-wall carbon nanotube (with a length of 26 μm) dispersed in water was used and the contents of the polyester resin and the acrylic resin were changed, to produce a sieving net in Example 3.

Comparative Example 1 (Sieving Net)

A net body was obtained using the same procedure as in Example 1. The resulting net body was a sieving net in Comparative Example 1.

Table 1 lists the composition of each coating layer in the sieving nets of the Examples and Comparative Example. In addition, Table 1 shows the thickness of each coating layer and the volume resistivity of each coating layer. Note that the thickness t of the coating layer was calculated by measuring, using sieving net cross-sections at three arbitrary points of the sieving net, the respective thicknesses of the coating layer under a scanning electron microscope (SEM) and by adding and averaging the measured thicknesses of the coating layer. Meanwhile, the volume resistivity of each coating layer was calculated by assigning the surface resistivity $\rho_s$ of the coating layer, as measured in accordance with JISK7194 (in the year 1994), and the resulting thickness t of the coating layer to the above formula (1).

TABLE 1

| | | Sieving net | | | |
|---|---|---|---|---|---|
| | | Example 1 | Example 2 | Example 3 | Comparative Example 1 |
| Base material | | Nylon | Nylon | Nylon | Nylon |
| Composition of coating layer | Polyester resin (mass %) | 28.2 | 28.05 | 27.9 | — |
| | Acrylic resin (mass %) | 65.8 | 65.45 | 65.1 | — |
| | Surfactant (mass %) | 1 | 1 | 1 | — |
| | Kind of carbon nanotube | Single-wall | Single-wall | Multi-wall | — |
| | Carbon nanotube (mass %) | 1 | 2.5 | 2 | — |
| | Cross-liker | 4 | 4 | 4 | — |
| | Total | 100 | 100 | 100 | — |
| Thickness of coating layer (μm) | | 0.4 | 0.5 | 0.4 | — |
| Volume resistivity of coating layer (Ω · cm) | | 10 | 0.25 | $1 \times 10^9$ | — |

[Sieving Performance Evaluation]

Figure 9:
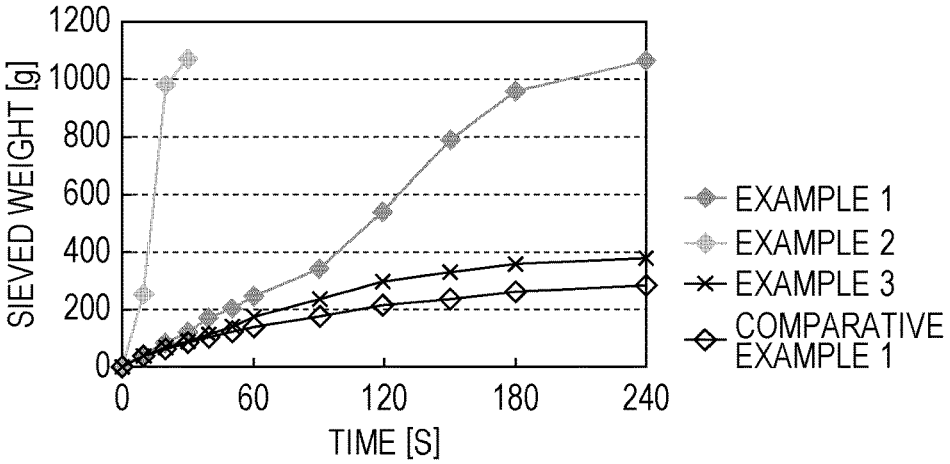
FIG. 9 is a graph showing how time was correlated with the weight of powder that had passed through a sieving net.

A test sifter TS-245 (manufactured by Tokyo Seifunki, Ltd.) was used. Each sieving net in the Examples and Comparative Example was stretched at a length of 20 cm and a width of 20 cm on a lumber frame. Next, 1200 g of starch powder (with a volume-average particle size of 40 μm; manufactured by HOKUREN CO., LTD.) was put therein. Then, the test shifter was operated and the sieved weight per 10 seconds was measured. FIG. 9 shows the results from the start of the test sifter operation until 240 seconds had passed.

As shown in FIG. 9, at 30 seconds after the start of the test sifter operation, the weight of starch powder that had passed through each sieving net in Examples 1 to 3 became larger than that through the sieving net in Comparative Example 1. In addition, at 240 seconds after the start of the test sifter operation, the weight of starch powder that had passed through each sieving net in Examples 1 to 3 was increased by 80 g or more when compared to that through the sieving net in Comparative Example 1. From the results, it was understandable that in the sieving nets in the Examples 1 to 3, a static charge was able to be suppressed, so that the powder sieving efficiency was excellent.

Here, at 240 seconds after the start of the test sifter operation, 1000 g or more starch powder passed through the sieving net using a single-wall carbon nanotube in Example 1. At 30 seconds after the start of the test sifter operation, 1000 g or more starch powder passed through the sieving net using a single-wall carbon nanotube in Example 2. By contrast, at 240 seconds after the start of the test sifter operation, just about 400 g starch powder passed through the sieving net using a multi-wall carbon nanotube in Example 3. From these results, it was understandable that when the content of carbon nanotube was comparable, use of a single-wall carbon nanotube made it possible to have a less static charge and a more improved sieving efficiency than use of a multi-wall carbon nanotube. Besides, from these results, it was also understandable that as the volume resistivity decreased from $1\times10^9$ Ω·cm to 0.25 Ω·cm, a static charge was more easily suppressed and the sieving efficiency improved more.

[Attachment Evaluation]

Figure 10:
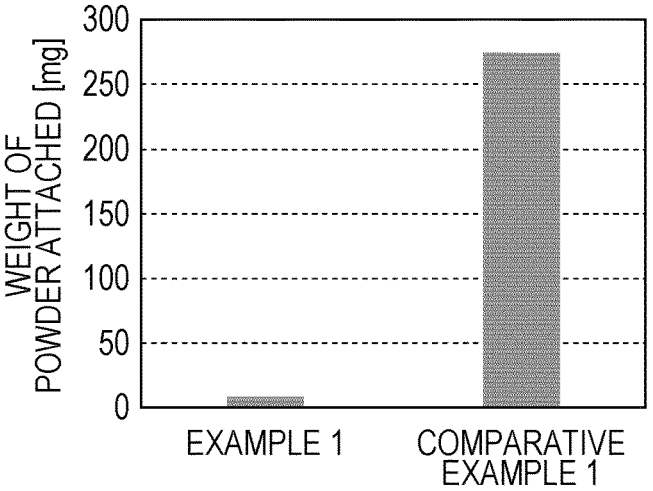
FIG. 10 is a graph showing how much powder was attached to a sieving net.

The sieving nets in Example 1 and Comparative Example 1 were each cut into 10-cm squares, on which starch powder was then sprinkled. After that, slight impacts were imposed such that the starch powder was fallen through the sieving net. Here, the weight of the sieving net before and after the starch powder was attached was measured. In this way, the weight of starch powder attached to the sieving net was calculated. FIG. 10 shows the results.

It was understandable from FIG. 10 that the weight of starch powder attached after the impacts were imposed was smaller by 250 mg or more in the case of the sieving net in Example 1 than in the case of the sieving net in Comparative Example 1. From these results, it was understandable that a static charge was more easily suppressed in and starch powder was less attached to the sieving net in Example 1 than in/to the sieving net in Comparative Example 1.

Reference Example 1

A polyester resin, an acrylic resin, a nonionic surfactant (WET 510, manufactured by Evonik Industries AG), and a single-wall carbon nanotube (with a length of 1 μm or more and 20 μm or less) were dispersed in water to prepare a carbon nanotube dispersion. This dispersion was mixed with water to prepare 4 different coating liquids with varied contents of single-wall carbon nanotube. The resulting coating liquids were each applied onto a film by using a bar coater. The coating liquid applied onto each film was dried with hot air to prepare 4 different films having a coating layer.

Reference Example 2

The same conditions as in Reference Example 1 were used, except that instead of the carbon nanotube dispersion used in Reference Example 1, a carbon nanotube dispersion containing a multi-wall carbon nanotube (with a length of 26 μm) dispersed in water was used, to prepare 4 different coating liquids with varied contents of multi-wall carbon nanotube. The resulting coating liquids were each applied onto a film by using a bar coater. The coating liquid applied onto each film was dried with hot air to prepare 4 different films having a coating layer.

Figure 11:
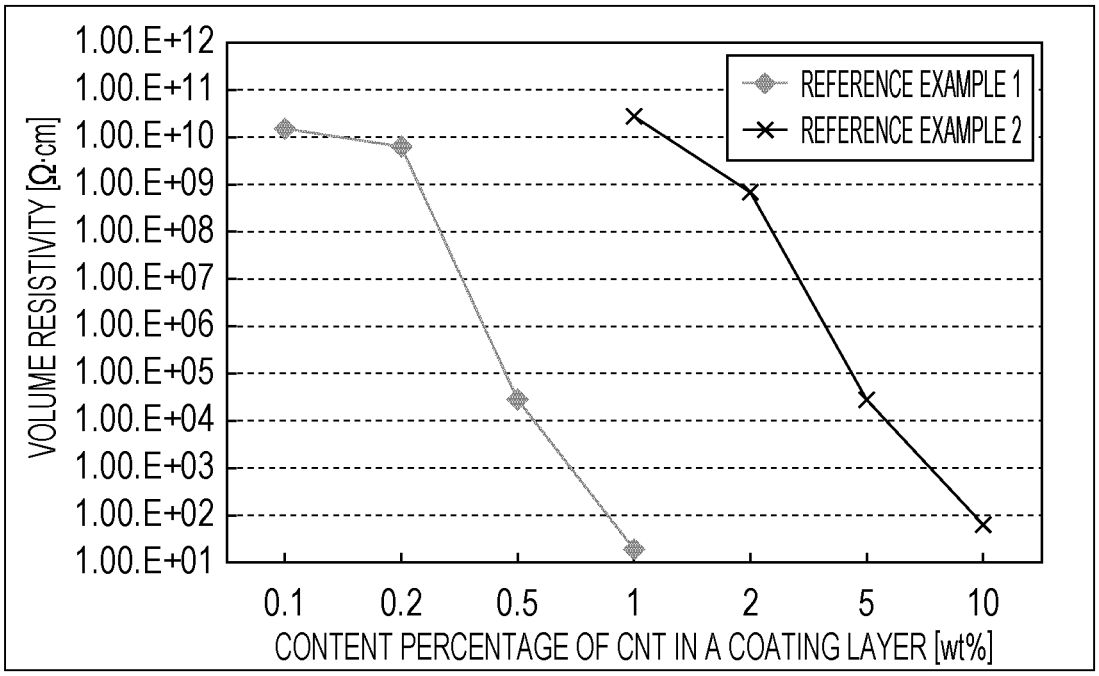
FIG. 11 is a graph showing how the content of carbon nanotube was correlated with volume resistivity.

The volume resistivity of the coating layer formed on each film in the Reference Examples was measured. Note that the volume resistivity was measured under the same conditions as in Example 1. FIG. 11 shows the results.

As shown in FIG. 11, regarding the films using a single-wall carbon nanotube in Reference Example 1, inclusion of the carbon nanotube in the amount of 0.3 mass % or higher allowed for a coating layer with a volume resistivity (of $1\times10^8$ Ω·cm or lower) that made it easier to elicit antistatic performance. By contrast, regarding the films using a multi-wall carbon nanotube in Reference Example 2, inclusion of the carbon nanotube in the amount higher than 2.0 mass % was necessary to obtain a coating layer with a volume resistivity (of $1\times10^8$ Ω·cm or lower) that made it easier to elicit antistatic performance. From the results, it was understandable that even when the amount of carbon nanotube was small, the mesh member using a single-wall carbon nanotube had a less static charge than the mesh member using a multi-wall carbon nanotube.

In addition, the coating layers formed on the films in Reference Examples 1 to 2 were visually inspected. Regarding the films in Reference Example 1, the coating layer with a volume resistivity (of $1\times10^8$ Ω·cm or lower) that made it easier to elicit antistatic performance was transparent. By contrast, regarding the films in Reference Example 2, the coating layer with a volume resistivity (of $1\times10^8$ Ω·cm or lower) that made it easier to elicit antistatic performance was colored black. From the results, it was understandable that regarding the films using a single-wall carbon nanotube in Reference Example 1, transparency was easily kept even upon the formation of a coating layer with a volume resistivity (of $1\times10^8$ Ω·cm or lower) that made it easier to elicit antistatic performance. By contrast, it was understandable that regarding the films using a multi-wall carbon nanotube in Reference Example 2, transparency was unlikely to be kept upon the formation of a coating layer with a volume resistivity (of $1\times10^8$ Ω·cm or lower) that made it easier to elicit antistatic performance.

[Total Light Transmittance Evaluation]

A hazemeter NDH2000 (NIPPON DENSHOKU INDUSTRIES Co., LTD.) was used to measure a total light transmittance with respect to each film in Reference Example 1. When the amount of single-wall carbon nanotube was 0.1 mass %, the total light transmittance was 89.48%. When the amount was 2.0 mass %, the total light transmittance was 81.25%. From the results, it was understandable that when the concentration of single-wall carbon nanotube was set such that the total light transmittance was 80% or more and less than 90% and more preferably 85% or more and less than 90%, the transparency was more easily kept.

Next, an Example, where the mesh member in an embodiment of the invention is a screen fabric, will be described.

Example 1 (Screen Fabric)

A polyester resin, an acrylic resin, a nonionic surfactant (WET 510, manufactured by Evonik Industries AG), and a single-wall carbon nanotube (with a length of 1 μm or more and 20 μm or less) were dispersed in water to prepare a carbon nanotube dispersion. This dispersion was mixed with water to prepare a coating liquid. Also provided were polyethylene terephthalate-made fibers with a diameter of 35 μm. The fibers were used as warps and wefts and weaved into a plain fabric to produce a mesh woven fabric while the number of meshes (the number of yarns per inch) was 305 (yarns/inch). The resulting mesh woven fabric was subjected to corona treatment. The mesh woven fabric that underwent corona treatment was soaked into the coating liquid. In this way, the coating liquid was applied onto the mesh woven fabric. The coating liquid applied onto the mesh woven fabric was dried with hot air to form a coating layer on the surface of the mesh woven fabric. The mesh woven fabric having the coating layer was a screen fabric in Example 1.

Comparative Example 1 (Screen Fabric)

The same procedure as in Example 1 was repeated to obtain a mesh woven fabric. This commercially available mesh woven fabric, on which a vapor deposited film (containing neither a carbon nanotube nor graphene) was formed by sputtering using SUS304, was a screen fabric in Comparative Example 1.

Comparative Example 2 (Screen Fabric)

A mesh woven fabric was obtained using the same procedure as in Example 1. The mesh woven fabric obtained was a screen fabric in Comparative Example 2.

Table 2 lists the compositions of the coating layers in screen fabrics in the Example and Comparative Examples. In addition, Table 1 shows the thickness of each coating layer and the volume resistivity of each coating layer. Note that the thickness t of the coating layer was calculated by measuring, using screen fabric cross-sections at three arbitrary points of the screen fabric, the respective thicknesses of the coating layer under a scanning electron microscope (SEM) and by adding and averaging the measured thicknesses of the coating layer. Meanwhile, the volume resistivity of each coating layer was calculated by assigning the surface resistivity $\rho_s$ of the coating layer, as measured in accordance with JISK7194 (in the year 1994), and the resulting thickness t of the coating layer to the above formula (1).

TABLE 2

| | | Screen fabric | | |
|---|---|---|---|---|
| | | Example 1 | Comparative Example 1 | Comparative Example 2 |
| Composition of coating layer | Polyester resin (mass %) | 29.1 | — | — |
| | Acrylic resin (mass %) | 67.9 | — | — |
| | Surfactant (mass %) | 1 | — | — |
| | Carbon nanotube (mass %) | 2 | — | — |
| | SUS304 (mass %) | — | 100 | — |
| | Total (mass %) | 100 | 100 | — |
| Thickness of coating layer (μm) | | 0.4 | 0.05 | — |
| Volume resistivity of coating layer (Ω · cm) | | $1\times10^1$ | $1\times10^5$ | — |

[Antistatic Performance Evaluation]

Portions in the four side directions of each screen fabric in Example 1 and Comparative Example 1 were held by clamps of a fabric tensioning device, and were stretched at a tensile strength of 0.90 mm (30.4 N/cm) on an aluminum-made printing plate frame. A diazo-based photosensitive resin (trade name: AX-81; manufactured by Oji Tac Co., Ltd.) was applied using a bucket onto each screen fabric stretched on the printing plate frame. The photosensitive resin applied was then dried. Further, the photosensitive resin was repeatedly applied and dried, so that the thickness of the resin layer was 10 μm. After that, a mask was attached to the upper surface of the resin layer, which was then exposed to light and developed to form, on the surface of the screen fabric, a shielding film having an opening with a shape corresponding to a given printing pattern. In this way, a screen printing plate was obtained.

Figure 12:
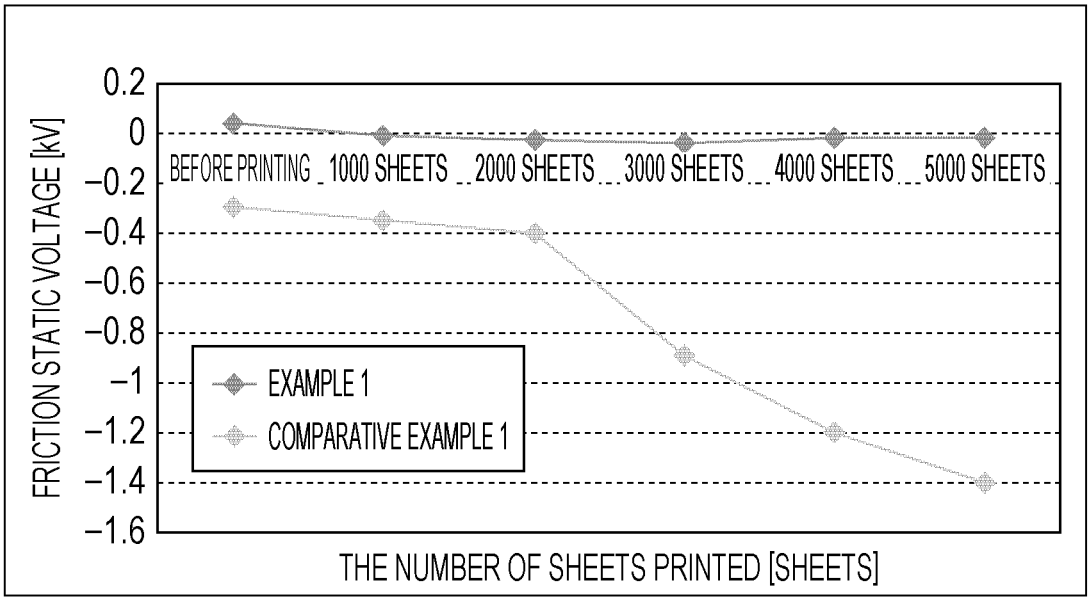
FIG. 12 is a graph showing the correlation between the number of printing sheets and a frictional static voltage.

The screen printing plate obtained was used and screen printing was carried out to yield 5000 sheets. The screen printing was carried out while the indentation (the distance of how much a squeegee descended with reference to the position of the tip of the squeegee in contact with a material to be printed) was set to 1 mm, the clearance (the distance between the screen fabric and the material to be printed) was set to 2.0 mm, and the printing rate was set to 200 mm/seconds. Before screen printing and every time 1000 sheets were produced by screen printing, ink was wiped and washing was conducted while swiped with a waste cloth impregnated in methyl ethyl ketone; the methyl ethyl ketone was then blown off by the air; and further drying was performed. After that, the friction static voltage of each screen fabric in Example 1 or Comparative Example 1 was measured. FIG. 12 shows the results.

As shown in FIG. 12, the screen fabric in Example 1 had a friction static voltage of about −0.01 kV after 5000 sheets were produced by screen printing. By contrast, the screen fabric in the Comparative Example had a friction static voltage of about −1.4 kV after 5000 sheets were produced by screen printing. In addition, in the screen fabric in Example 1, the friction static voltage was changed just by about −0.03 kV even after 5000 sheets were produced by screen printing. By contrast, in the screen fabric in Comparative Example 1, the friction static voltage was changed by −1.1 kV. From these results, it was understandable that the screen fabric in Example 1 had a less static charge even after the screen printing and the ink was able to be prevented from bleeding and splashing due to the static charge. That is, it was understandable that in the screen fabric in Example 1, a static charge was continuously suppressed.

[UV Light Reflectivity Evaluation]

A spectrophotometer (V-670, JASCO Corporation) was used to measure the reflectivity of light on each screen fabric in Example 1 or Comparative Example 2. UV light with a peak wavelength of 375 nm was used for measurement. The measurement results demonstrated that the light reflectivity in Example 1 was 7.23% and the light reflectivity in Comparative Example 2 was 8.26%. The light reflectivity was lower by about 1% in Example 1 than in Comparative Example 2. From this, it was found that irregular reflection during light exposure was lower and a given printing pattern including fine lines was more easily formed (the precision of opening in a shielding film is more likely to increase) in the screen fabric in Example 1 than in the screen fabric in Comparative Example 1.

Next, an Example of a mesh member having a graphene-containing coating layer will be described.

Example 1

A polyester resin, an acrylic resin, a nonionic surfactant (WET 510, manufactured by Evonik Industries AG), a cross-linker (oxazoline-based cross-linker), and graphene were dispersed in water to prepare a graphene dispersion. This dispersion was mixed with water to prepare a coating liquid. Also provided were nylon fibers with a diameter of 50 μm. The fibers were used as warps and wefts and weaved into a plain fabric to produce a mesh woven fabric while the number of meshes (the number of yarns per inch) was 200 (yarns/inch). The resulting mesh woven fabric was subjected to corona treatment. The mesh woven fabric that underwent corona treatment was soaked into the coating liquid. In this way, the coating liquid was applied onto the mesh woven fabric. The coating liquid applied onto the mesh woven fabric was dried with hot air to form a coating layer on the surface of the mesh woven fabric. The mesh woven fabric having the coating layer was a mesh member in Example 1.

Comparative Example 1

A polyester resin and an acrylic resin were blended to prepare a coating liquid. A mesh woven fabric was obtained using the same procedure as in Example 1. The resulting mesh woven fabric was subjected to corona treatment. The mesh woven fabric that underwent corona treatment was soaked into the coating liquid. In this way, the coating liquid was applied onto the mesh woven fabric. The coating liquid applied onto the mesh woven fabric was dried with hot air to form a coating layer on the surface of the mesh woven fabric. The mesh woven fabric having the coating layer was a mesh member in Comparative Example 1.

Table 3 lists the compositions of the coating layers in the mesh members in the Example and Comparative Example. In addition, Table 3 shows the thickness of each coating layer and the volume resistivity of each coating layer. Note that the thickness t of each coating layer and the volume resistivity of each coating layer were measured in the same way as above.

TABLE 3

| | | Mesh member | |
|---|---|---|---|
| | | Example 1 | Comparative Example 1 |
| Base material | | Nylon | Nylon |
| Composition of coating layer | Polyester resin (mass %) | 28.2 | 30 |
| | Acrylic resin (mass %) | 65.8 | 70 |
| | Surfactant (mass %) | 1 | — |
| | Graphene (mass %) | 1 | — |
| | Cross-liker | 4 | — |
| | Total | 100 | 100 |
| Thickness of coating layer (μm) | | 0.4 | 0.4 |
| Volume resistivity of coating layer (Ω · cm) | | 100 | $10^{11}$ |

As shown in Table 3, the mesh member in Example 1 had a lower volume resistivity of the coating layer than the mesh member in Comparative Example 1. From the results, it was understandable that in the mesh member in Example 1, a static charge was able to be suppressed.

The invention claimed is:

1. A mesh member comprising:

a mesh woven fabric formed of warps and wefts; and a coating layer that is formed on a surface of the mesh woven fabric and comprises a single-wall carbon nanotube and/or graphene, wherein the warps and the wefts consist of fibers with the coating layer formed on their surfaces, the mesh member is a sieving net or a screen fabric, and a weave of the mesh woven fabric is a plain weave, a twill weave or a sateen weave.

2. The mesh member according to claim 1, wherein the coating layer has a thickness of 0.1 μm or more and 1.0 μm or less.

3. The mesh member according to claim 1, wherein the coating layer has a volume resistivity of 0.01 Ω·cm or more and $1\times10^{8}$ Ω·cm or less.

4. The mesh member according to claim 1, wherein the mesh member is a sieving net.

5. A sieve comprising the mesh member used according to claim 4.

6. The mesh member according to claim 1, wherein the mesh member is a screen fabric.

7. A screen printing plate comprising the mesh member used according to claim 6.

8. The mesh member according to claim 1, wherein the warps and the wefts consist of resin fibers with the coating layer formed on their surfaces.

* * * * *